US008094030B2

(12) United States Patent
Escaich

(10) Patent No.: US 8,094,030 B2
(45) Date of Patent: Jan. 10, 2012

(54) FIRE DETECTION SYSTEM AND AIRCRAFT EQUIPPED WITH SUCH A SYSTEM

(75) Inventor: Laurent Escaich, Toulouse (FR)

(73) Assignee: Airbus Operations SAS, Toulouse (FR)

( * ) Notice: Subject to any disclaimer, the term of this patent is extended or adjusted under 35 U.S.C. 154(b) by 506 days.

(21) Appl. No.: 12/280,358

(22) PCT Filed: Feb. 21, 2007

(86) PCT No.: PCT/FR2007/000314

§ 371 (c)(1),
(2), (4) Date: Aug. 22, 2008

(87) PCT Pub. No.: WO2007/096523

PCT Pub. Date: Aug. 30, 2007

(65) Prior Publication Data

US 2009/0251322 A1 Oct. 8, 2009

(30) Foreign Application Priority Data

Feb. 24, 2006 (FR) ..... 06 50657

(51) Int. Cl.
*G08B 17/06* (2006.01)

(52) U.S. Cl. ..... 340/584; 340/508; 340/587; 340/593; 340/577; 340/628; 340/945; 340/507

(58) Field of Classification Search ..... 340/584, 340/500, 506, 510, 511, 577, 593, 507–509, 340/541–567, 587, 628
See application file for complete search history.

(56) References Cited

U.S. PATENT DOCUMENTS

| | | | | |
|---|---|---|---|---|
| 3,641,552 | A * | 2/1972 | Friberg | 340/508 |
| 3,778,796 | A * | 12/1973 | Honda | 340/517 |
| 4,218,677 | A * | 8/1980 | Wilson et al. | 340/506 |
| 4,287,515 | A * | 9/1981 | Raber et al. | 340/584 |
| 4,414,539 | A * | 11/1983 | Armer | 340/500 |
| 4,524,349 | A * | 6/1985 | Hyatt | 340/500 |
| 4,580,138 | A | 4/1986 | Morrison | |
| 4,651,138 | A | 3/1987 | Morrison | |
| 4,847,719 | A * | 7/1989 | Cook et al. | 361/13 |
| 4,939,511 | A * | 7/1990 | Hinckley | 340/13.38 |

FOREIGN PATENT DOCUMENTS

DE 33 00 964 A1 8/1983

(Continued)

*Primary Examiner* — George Bugg
*Assistant Examiner* — Anne Lai
(74) *Attorney, Agent, or Firm* — Oblon, Spivak, McClelland, Maier & Neustadt, L.L.P.

(57) ABSTRACT

A fire detection system comprises a detection unit ($\mathbf{2}_A$) able to measure an electrical quantity between a first ($BO_A$) and a second ($B\mathbf{1}_A$) terminal, and a first detector ($\mathbf{11}_A$) connected to the first and second terminals ($BO_A$, $B\mathbf{1}_A$) and able to form a first value of the electrical quantity in a determined state of the first detector, for example in the event of the detecting of a fire in a first zone (Z). A second detector ($\mathbf{12}_A$) connected to the first and second terminals ($BO_A$, $B\mathbf{1}_A$) is able to form a second value of the electrical quantity in said determined state, that is to say for example in the event of the detecting of a fire in a second zone, and a third value of the electrical quantity in another state different from the determined state, that is to say for example during normal operation. The first value and the third value are different from the second value.

9 Claims, 2 Drawing Sheets

FOREIGN PATENT DOCUMENTS

| | | | |
|---|---|---|---|
| EP | 0 071 752 | A1 | 2/1983 |
| EP | 0 093 095 | | 11/1983 |
| EP | 0 253 709 | | 1/1988 |
| EP | 1 369 835 | A1 * | 12/2003 |
| GB | 2 286 735 | | 8/1995 |
| GB | 2 321 747 | A | 8/1998 |
| SU | 415684 | | 2/1974 |
| SU | 1647616 | A1 | 5/1991 |

* cited by examiner

FIRE DETECTION SYSTEM AND AIRCRAFT EQUIPPED WITH SUCH A SYSTEM

BACKGROUND OF THE INVENTION

1. Field of the Invention

The invention relates to a fire detection system and to an aircraft equipped with such a system.

2. Discussion of the Background

Fire detection systems, for example in aircraft, traditionally comprise a detection unit (or FDU from the English "Fire Detection Unit") that receives information items from a set of detectors covering an area to be monitored and processes them for transmission to a display module, in the case of aircraft situated in the cockpit of the plane.

In general, a set of identical detectors is distributed over the area to be protected; each detector is therefore associated with a particular zone of the area and delivers a determined value of an electric quantity (for example, such as the resistance that the detector forms in the electric circuit connecting it to the detection unit), depending on the information item to be transmitted about the state of the detector: normal operation, detector failure or presence of a fire in the zone in question.

The different detectors are traditionally connected in parallel to the detection unit, thus making it possible in particular to limit the wiring necessary for installation of the function over the entire area to be protected.

However, the connecting in parallel of identical detectors makes it impossible to differentiate, in the detection unit, the detector transmitting a particular signal.

Nevertheless, it is of interest to determine which detector is the source of a particular information item, not only so that the detected fire can be located but also so that a faulty detector can be identified precisely and quickly during maintenance.

Furthermore, in systems that use two redundant channels to transmit the information item, precise determination of the zone in which a fire is detected makes it possible to limit alert situations in case both information channels are signaling a fire in the same zone (and not as soon as a fire is detected by each channel in some zone of the area).

In order to meet these expectations at least in part without however, necessitating expansion of the wiring necessary for installation of two detectors, the invention proposes a fire detection system that comprises a detection unit capable of measuring an electric quantity between a first and a second terminal, and a first detector connected to the first and second terminals and capable of forming a first value of the electric quantity in a determined state of the first detector, characterized by a second detector connected to the first and second terminals and capable of forming a second value of the electric quantity in the said determined state and a third value of the electric quantity in another state distinct from the said determined state, the first value and the third value being different from the second value.

Thus, even though the two detectors are connected in parallel, the different values of the electric quantity (first value and second value) make it possible to determine, in the detection unit, which detector is in the determined state (or in other words, for example, by which detector the fire has been detected) and thus to locate the corresponding zone precisely. Furthermore, the changeover between this same second value and the third value makes it possible to detect a change of state of the second detector.

The changes of value of the same quantity thus make it possible to transmit the state and the location of a given detector simultaneously to the detection unit, even though a parallel connection is being used.

The determined state corresponds, for example, to the detection of a fire by the detector in question.

Alternatively, the determined state may be normal operation of the detector, in which case it will be possible to locate the detection of a fire by virtue of the location of the normally operating detector and then by deduction.

The determined state also may correspond to a failure of the detector in question, in which case locating of the detector facilitates maintenance.

In the case in which the determined state corresponds to detection of a fire, it can be additionally provided that the first detector is capable of forming a fourth value of the electric quantity in normal operation and that the second detector is capable of forming the third value of the electric quantity in normal operation, the third value being different from the fourth value. It can then be provided that the first detector is capable of forming a fifth value of the electric quantity in case of failure and that the second detector is capable of forming the same fifth value of the electric quantity in case of failure.

When a single detector has failed, it will be possible to locate it precisely by virtue of the difference between the third and fourth values.

SUMMARY OF THE INVENTION

According to a conceivable variant, different values of the electric quantity could be provided for the first and second detectors in case of failure.

The second value, for example, differs by more than 10% from the first value, which makes it possible to ensure a distinction between the values formed by the two detectors.

In the embodiment envisioned hereinafter, the electric quantity is a resistance.

The detection unit furthermore may be provided with a third terminal, and a third detector connected to the third terminal then may form a determined value of the electric quantity in case of detection of a fire in a third zone.

In this way it is possible to distinguish the origin of the information item by determining which terminal is measuring the electric value in question.

In this case it is possible to provide that the detection unit is capable of measuring the electric quantity cyclically at the second terminal and at the third terminal, in order to monitor cyclically the first group of detectors (first and second detectors), then the second group (third detector).

The third detector can be connected between the third terminal and the first terminal in order to limit the necessary wiring.

Moreover, the combination of the two techniques envisioned for locating the detector in question (different electric quantities on the one hand and time multiplexing on the other hand), associated with the use of a common ground, permits an attractive compromise between the amount of wiring necessary and the reliability of the transmitted information item.

The invention also proposes, in a manner original in itself, a fire detection system comprising a detection unit capable of measuring an electric quantity, a first detector (or group of detectors) connected to a first terminal of the detection unit and capable of forming a value of the electric quantity in case of detection of a fire in a first zone, characterized by a second detector (or group of detectors) connected to a second terminal of the detection unit and capable of forming a value (which may be identical to that mentioned in the foregoing) of the electric quantity in case of detection of a fire in a second zone, the detection unit being capable of measuring the value of the electric quantity successively and cyclically at the first terminal and at the second terminal.

In this way the detector from which a determined information item originated can be determined by time multiplexing and consequently the zone in question can be located.

In this case the first detector and the second detector also can be connected to the detection unit at a common terminal, thus making it possible to limit the wiring necessary for installation of these detectors.

The invention also proposes an aircraft equipped with such a system.

BRIEF DESCRIPTION OF THE DRAWINGS

Other characteristics and advantages of the invention will become apparent in the light of the description hereinafter with reference to the attached drawings, wherein.

DETAILED DESCRIPTION OF THE PREFERRED EMBODIMENTS

Figure 1:
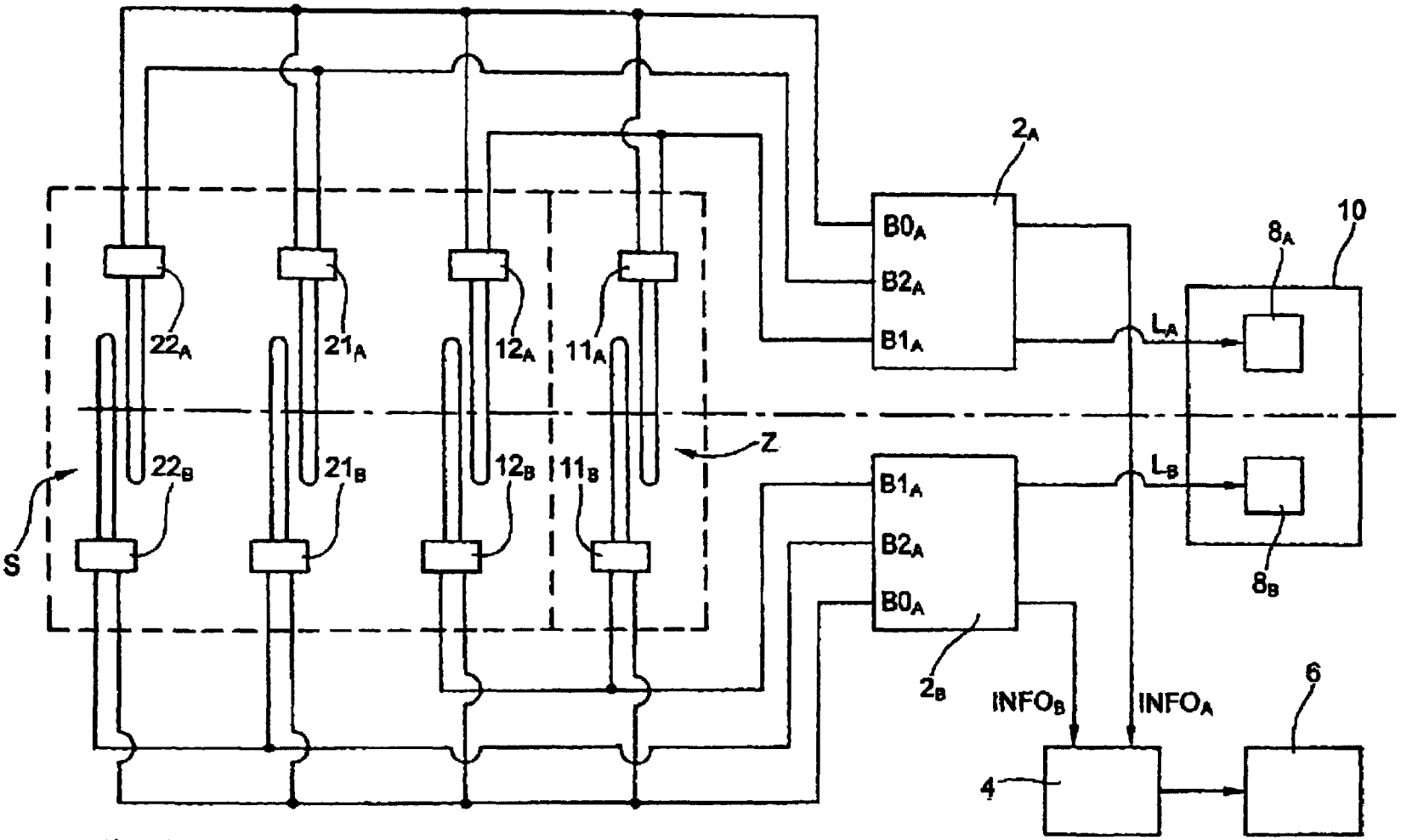
FIG. 1 represents a fire detection system that embodies the teachings of the invention.

The fire detection system represented in FIG. 1 is constructed on the basis of two redundant channels (or redundant paths) in order in particular to improve the detection of a fire, each channel having an independent electric power supply for better operating safety.

The elements of each channel will be identified by means of an index, or in other words by the letter "A" for the first channel designated as "channel A", and by the letter "B" for the second channel designated as "channel B".

The description hereinafter will concentrate on the elements of channel A, with the understanding that those of channel B are deduced therefrom by symmetry, as is furthermore clearly visible in FIG. 1.

A detection unit $\mathbf{2}_A$ (or FDU from the English "Fire Detection Unit") monitors a set of detectors $\mathbf{11}_A$, $\mathbf{12}_A$, $\mathbf{21}_A$, $\mathbf{22}_A$ associated with an area S to be monitored and transmits an information item $INFO_A$ representative of the state of these detectors to a logic module 4, as well as an information item about control $L_A$ of an indicator light $\mathbf{8}_A$ of a display module 10.

Detection unit $\mathbf{2}_A$ is implemented, for example, by means of a microprocessor.

As already mentioned, the interest here lies in the part of detection unit $\mathbf{2}_A$ dedicated to channel A, knowing that another part $\mathbf{2}_B$ of the detection unit is dedicated to channel B. In the case described here, entities $\mathbf{2}_A$ and $\mathbf{2}_B$ are effectively grouped inside the detection unit (but have independent electric power supplies). Alternatively, of course, parts $\mathbf{2}_A$ and $\mathbf{2}_B$ could be constructed as two physically separated detection units.

Detection unit $\mathbf{2}_A$ comprises a plurality of terminals $BO_A$, $B\mathbf{1}_A$, $B\mathbf{2}_A$ for connection to detectors $\mathbf{11}_A$, $\mathbf{12}_A$, $\mathbf{21}_A$, $\mathbf{22}_A$ of area S to be monitored.

Among these terminals, one ground terminal $BO_A$ is connected electrically to all detectors $\mathbf{11}_A$, $\mathbf{12}_A$, $\mathbf{21}_A$, $\mathbf{22}_A$ of area S, which therefore have a common ground.

Between each of the other terminals $B\mathbf{1}_A$, $B\mathbf{2}_A$ there is connected a plurality of detectors (in this case specifically detectors $\mathbf{11}_A$, $\mathbf{12}_A$ for terminal $B\mathbf{1}_A$ and $\mathbf{21}_A$, $\mathbf{22}_A$ for terminal $B\mathbf{2}_A$), which form a group of detectors associated with this terminal.

Detection unit $\mathbf{2}_A$ comprises means for measuring the resistance present between ground terminal $BO_A$ and each of the other terminals $B\mathbf{1}_A$, $B\mathbf{2}_A$ successively in time and in periodic manner (or in other words cyclically), the duration of measurement of the resistance between two terminals naturally being compatible with the response time of the detectors and with the response time desired for detection of a fire.

Detection unit $\mathbf{2}_A$ therefore cyclically monitors (for example, according to the instructions of a program installed in the microprocessor) groups of detectors (a first group of detectors being composed here of detector $\mathbf{11}_A$ and detector $\mathbf{12}_A$, and a second group of detectors being composed here of detector $\mathbf{21}_A$ and detector $\mathbf{22}_A$). By virtue of this time-multiplexing technique, detection unit $\mathbf{2}_A$ is able to determine one information item (represented here by the resistance measured between the terminals in question) per group of detectors, thus making possible an initial locating of the origin of the information within area S to be monitored.

In each group of detectors, there are also used detectors that are globally identical in terms of structure but that return different resistance values for the same information item to be transmitted (for example, an information item about detection of a fire). It will be noted, nevertheless, that transducers of two different groups (meaning that they are differentiated by their connection to at least one terminal of the detection unit) may be identical. For example, in the case of FIG. 1, it is possible to provide identical detectors $\mathbf{11}_A$ and $\mathbf{21}_A$ and identical detectors $\mathbf{12}_A$ and $\mathbf{22}_A$.

Figure 2:
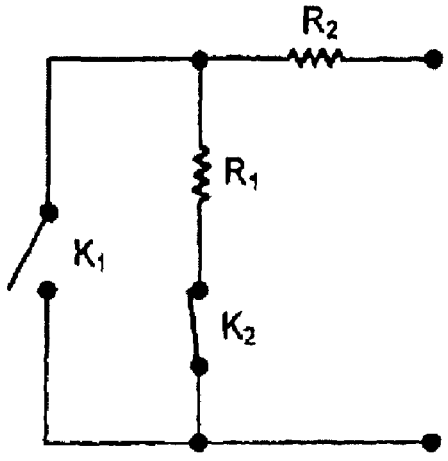
FIG. 2 represents the equivalent electrical schematic of a detector of FIG. 1 in normal operation.

FIG. 2 represents the equivalent electrical schematic of a detector such as those used in FIG. 1 in the case of normal operation (or in other words in the absence of failure and in the absence of detection of a fire).

This electrical schematic comprises the parallel association of a first switch $K_1$ and the series association of a second switch $K_2$ and a first resistance $R_1$. The equivalent electrical circuit at the detector terminals is formed by the series association of this parallel association and a second resistance $R_2$, as clearly visible in FIG. 2.

First switch $K_1$ is tripped (closed in this case) by the detection of a fire in the zone in question (zone Z for detector $\mathbf{11}_A$). In turn, second switch $K_2$ is tripped (opened in this case) by the detection of an operating fault of the detector.

In normal operation, as represented in FIG. 2, first switch $K_1$ is therefore open and thus second switch $K_2$ is closed, so that the detector has a resistance formed by the series association of resistances $R_1$ and $R_2$, or in other words an equivalent resistance $R_1+R_2$.

Figure 3:
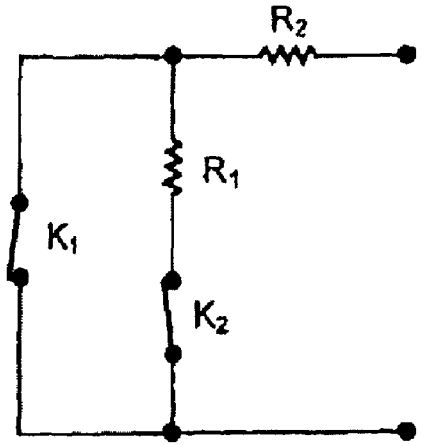
FIG. 3 represents the equivalent electrical schematic of such a detector in case of detection of a fire.

In the case of detection of a fire in the zone monitored by the detector, first switch $K_1$ closes and short-circuits the series association of first resistance $R_1$ and second switch $K_2$, so that the detector forms an equivalent resistance on the order of $R_2$, as represented in FIG. 3 (and this, moreover, is the situation regardless of the position of second switch $K_2$).

Figure 4:
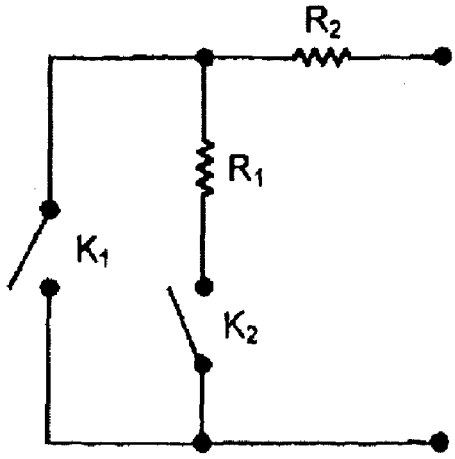
FIG. 4 represents the equivalent electrical schematic of such a detector in case of failure of the detector.

In the absence of fire, but in the presence of a failure, as represented in FIG. 4, first and second switches $K_1$, $K_2$ are open, so that the detector has extremely high, theoretically infinite, resistance.

As already mentioned, it is provided that the different detectors of each group (meaning the different detectors connected in parallel to the same two terminals of the detection unit) have different resistances. In the case represented in FIG. 1, for example, detectors $\mathbf{11}_A$ and $\mathbf{12}_A$ have the resistance values summarized in the table below:

| Resistance | Detector $11_A$ (Ω) | Detector $12_A$ (Ω) |
|---|---|---|
| R1 | 2130 | 4300 |
| R2 | 1600 | 860 |
| NORMAL equivalent resistance | 3730 | 5160 |
| FIRE equivalent resistance | 1600 | 860 |
| FAILURE equivalent resistance | ∞ | ∞ |

Therefore, even though detectors $\mathbf{11}_A$, $\mathbf{12}_A$ of the same group are connected in parallel, it will be possible to determine precisely from which detector the information item originates (and thus the zone corresponding thereto), since the values associated with the same information item vary from one detector to the other.

In the table below there is presented the resistance value measured by detection unit $\mathbf{2}_A$ in the diverse conceivable situations, resulting from the mounting in parallel of detectors $\mathbf{11}_A$ and $\mathbf{12}_A$ and allowing for tolerances of ±5% on the value of resistances $R_1$ and $R_2$ and for the wiring resistance by means of a margin of ±10% of the equivalent resistance value obtained.

| State of detectors $11_A$ and $12_A$ | Equivalent resistance (Ω) | Equivalent resistance − 10% (Ω) | Equivalent resistance + 10% (Ω) |
|---|---|---|---|
| $11_A$ = Normal<br>$12_A$ = Normal | 2165 | 1948 | 2381 |
| $11_A$ = Normal<br>$12_A$ = Fire | 699 | 629 | 769 |
| $11_A$ = Fire<br>$12_A$ = Normal | 1221 | 1099 | 1343 |
| $11_A$ = Fire<br>$12_A$ = Fire | 559 | 503 | 615 |
| $11_A$ = Normal<br>$12_A$ = Failure | 3716 | 3345 | 4088 |
| $11_A$ = Fire<br>$12_A$ = Failure | 1597 | 1438 | 1757 |
| $11_A$ = Failure<br>$12_A$ = Normal | 5134 | 4620 | 5647 |
| $11_A$ = Failure<br>$12_A$ = Fire | 859 | 773 | 945 |
| $11_A$ = Failure<br>$12_A$ = Failure | ∞ | ∞ | ∞ |

It is noted that the value ranges defined in the foregoing table for each conceivable combination of states of detectors $\mathbf{11}_A$ and $\mathbf{12}_A$ do not overlap, and so it is possible to deduce the state of each of the two detectors from the resistance value measured by detection unit $\mathbf{2}_A$, despite the connection in parallel of these detectors.

In this way the origin of the information item can be precisely located among the detectors of the same group, with minimum wiring for installation of the connectors of this group.

The information items relating to the status of each detector, obtained by virtue of time multiplexing or of differentiation of the detectors by means of the different resistances that they form, are transmitted to logic module 4, for example in the form of an encoded binary word $INFO_A$.

It is effectively provided here that the encoded word $INFO_A$ represents the state of the different detectors $\mathbf{11}_A$, $\mathbf{12}_A$, $\mathbf{21}_A$, $\mathbf{22}_A$. Alternatively, it could be provided that detection unit $\mathbf{2}_A$ communicates to logic module 4 only information items relating to the group of transducers being monitored, so that logic module 4 would receive information items about the different transducer groups by time multiplexing.

In all cases, logic module 4 also receives information items $INFO_B$ of channel B and combines the received information items in order to obtain and transmit, to a computerized management system 6 of the aircraft, a dependable information item relating to possible detection of fire in the different zones Z of monitored area S.

As already mentioned, detection unit $\mathbf{2}_A$ also may command an indicator light $\mathbf{8}_A$ to glow when a fire is detected in any of zones Z of area S to be monitored.

The embodiment just described represents only one possible example of the use of the invention.

The invention claimed is:

1. A fire detection system, comprising:

a detection unit configured to measure an electric quantity between a first terminal and a second terminal;

a first detector connected to the first and second terminals and configured to form a first value of the electric quantity in a determined state of the first detector, the determined state corresponds to a detection of a fire; and a second detector connected to the first and second terminals and configured to form a second value of the electric quantity in the determined state and a third value of the electric quantity in another state distinct from the determined state, the first value and the third value being different from the second value, wherein the first detector is configured to form a fourth value of the electric quantity in normal operation and wherein the second detector is configured to form the third value of the electric quantity in normal operation, the third value being different from the fourth value.

2. A fire detection system, comprising:

a detection unit configured to measure an electric quantity between a first terminal and a second terminals;

a first detector connected to the first and second terminals and configured to form a first value of the electric quantity in a determined state of the first detector, the determined state corresponds to a detection of a fire; and a second detector connected to the first and second terminals and configured to form a second value of the electric quantity in the determined state and a third value of the electric quantity in normal operation, the first value and the third value being different from the second value, and the second detector is configured to form a fourth value of the electric quantity, distinct from the second and third values, in a case of failure.

3. A detection system according to claim 2, wherein the first detector is configured to form the fourth value of the electric quantity in case of failure.

4. A detection system according to claim 2, wherein the second value differs by more than 10% from the first value.

5. A detection system according to one of claims 2 and 1 to 4, wherein the electric quantity is a resistance.

6. A detection system according to claim 2, wherein the detection unit is provided with a third terminal and wherein a third detector connected to the third terminal is configured to form a determined value of the electric quantity in case of detection of a fire in a third zone.

7. A detection system according to claim 6, wherein the detection unit is configured to measure the electric quantity cyclically at the second terminal and at the third terminal.

8. A detection system according to claim 6, wherein the third detector is connected between the third terminal and the first terminal.

9. An aircraft, including a fire detection system according to claim 2.

* * * * *